US006164172A

United States Patent [19]

Huang

[11] Patent Number: 6,164,172

[45] Date of Patent: Dec. 26, 2000

[54] TOOL HANDLE HAVING TOOL MEMBERS RECEIVING STRUCTURE

[76] Inventor: Yung Hsu Huang, No. 10, Lane 38, Li Der Street, Taiping City, Taichung Hsien, Taiwan

[21] Appl. No.: 09/243,596

[22] Filed: Feb. 3, 1999

[51] Int. Cl.[7] ..... B25G 1/08

[52] U.S. Cl. ..... 81/490; 81/439; 81/177.4; 7/165

[58] Field of Search ..... 81/177.4, 437, 81/439, 490; 7/165

[56] References Cited

U.S. PATENT DOCUMENTS 5,896,606 4/1999 Huang ..... 7/165
5,901,622 5/1999 Sweeny ..... 81/439
5,916,341 6/1999 Lin ..... 81/439 X
5,927,162 7/1999 Huang ..... 81/490 X
5,931,061 8/1999 Kuo ..... 81/490 X

*Primary Examiner*—James G. Smith
*Attorney, Agent, or Firm*—Charles E. Baxley, Esq.

[57] ABSTRACT

A tool includes a handle having one or more orifices formed in one end for receiving tool members and having a peripheral groove communicating with the orifices for allowing the users to view and to obtain the required the tool member. The handle includes one or more chambers and one or more cavities communicating with each other for receiving tool members. A driving stem is secured to the handle for driving the tool members. A telescopic tube is further engaged in the handle and has a magnet extendible to attract the tool members. A door may enclose the chamber of the handle.

8 Claims, 5 Drawing Sheets

TOOL HANDLE HAVING TOOL MEMBERS RECEIVING STRUCTURE

BACKGROUND OF THE INVENTION

1. Field of the Invention

The present invention relates to a tool, and more particularly to a tool handle having a structure for receiving a lot of tool members.

2. Description of the Prior Art

Typical tools comprise a handle having a chamber for receiving the tool members. However, only few tool members may be received in the tool handle.

The present invention has arisen to mitigate and/or obviate the afore-described disadvantages of the conventional tools.

SUMMARY OF THE INVENTION

The primary objective of the present invention is to provide a tool including a handle having a structure for receiving a lot of tool members.

In accordance with one aspect of the invention, there is provided a tool comprising a handle including a first end having at least one orifice formed therein for receiving a tool member and having a peripheral groove formed therein and communicating with the orifice for allowing a user to view the tool member, the handle including a second end and including a middle portion having at least one chamber formed therein and having at least one cavity formed therein and communicating with the chamber for receiving another tool member, and a driving stem secured to the first end of the handle for driving the tool members.

The handle further includes an aperture formed in the first end of the handle, and a telescopic tube engaged in the aperture of the handle and having a magnet extendible outward of the handle for attracting the tool members. The aperture is communicated with the peripheral groove of the handle.

One or more doors are detachably attached to the handle for enclosing the chamber of the handle. The handle includes at least one pair of channels for slidably receiving the door and for allowing the door to be detachably attached to the handle.

The second of the handle includes a T-shaped depression formed therein for engaging with and for driving a further tool member.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
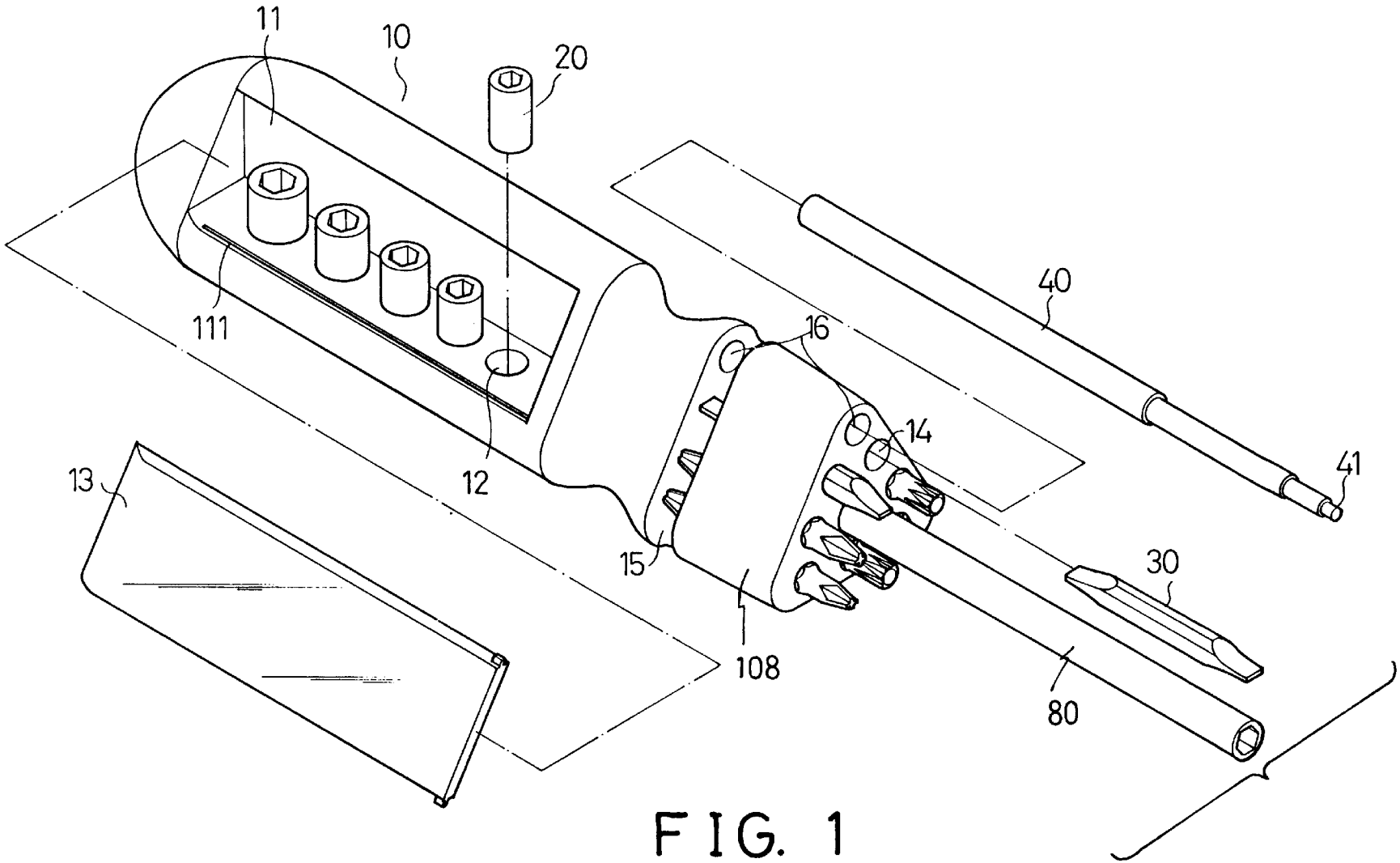
FIG. 1 is an exploded view of a tool in accordance with the present invention.
Figure 2:
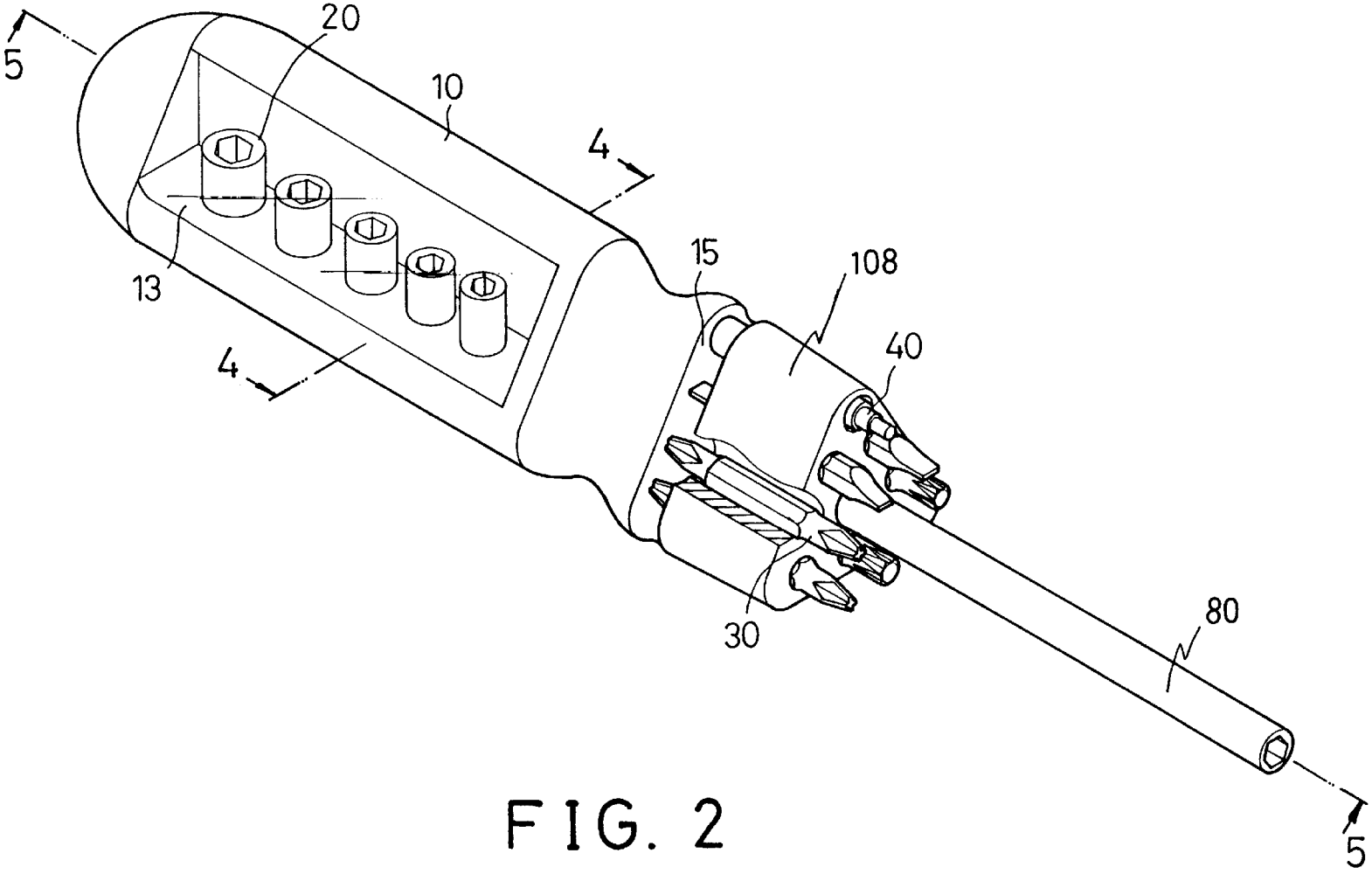
FIG. 2 is a front perspective view of the tool.
Figure 3:
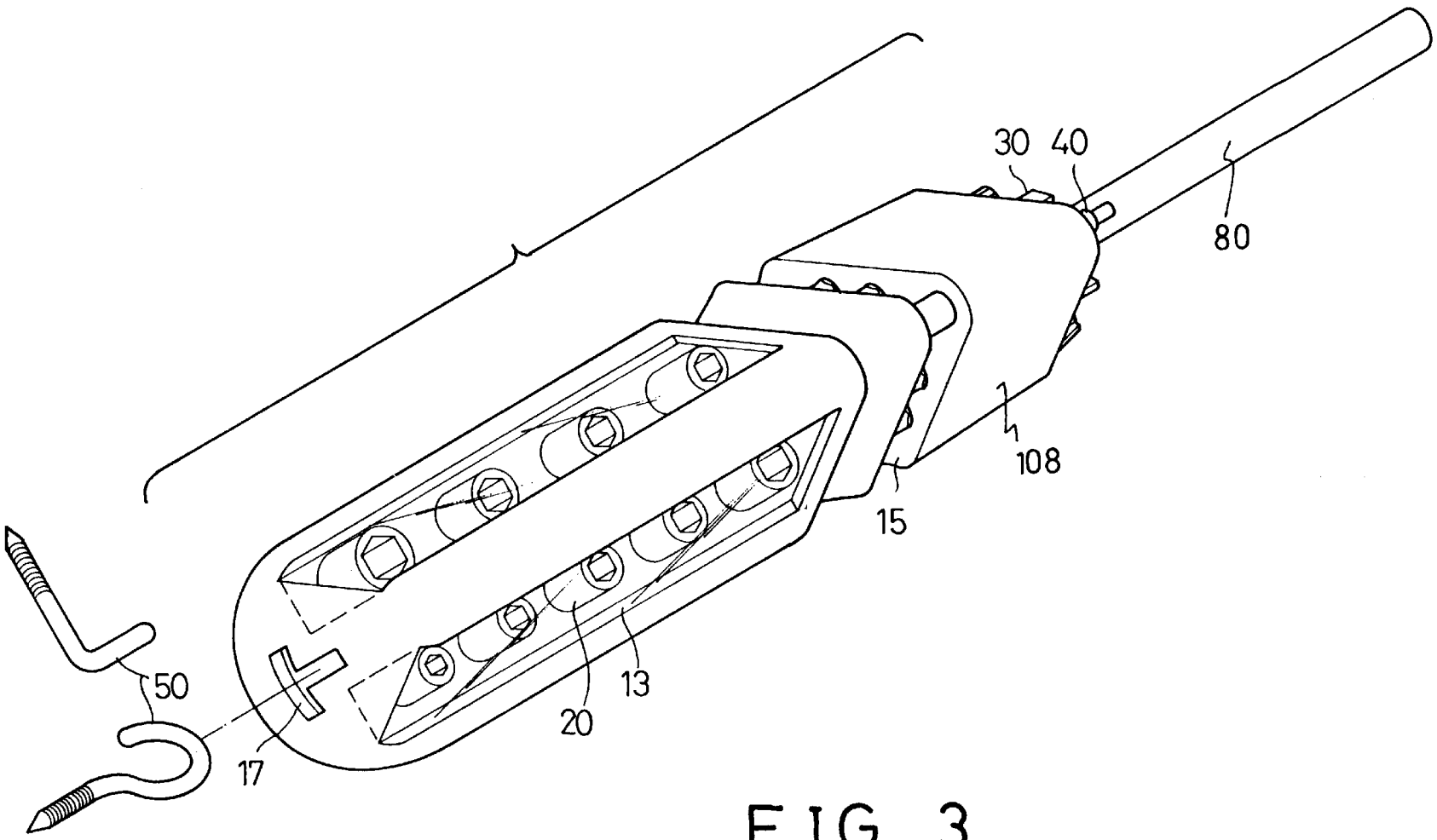
FIG. 3 is a rear perspective view illustrating the application of the tool.

Referring to the drawings, and initially to FIGS. 1–3, a tool in accordance with the present invention comprises a handle 10 and a driving stem 80 secured to the handle 10 so as to be rotated and driven by the handle 10. The handle 10 includes a triangular cross section having one or more chambers 11 formed in the middle portion and having one or more cavities 12 formed therein and communicating with the chamber 11 for receiving tool members, such as the sockets 20. The handle 10 includes one or more pairs of channels 111 formed therein for slidably receiving one or more doors 13. The doors 13 are provided for enclosing the chambers 11 and are preferably made of transparent materials for allowing the user to view and to obtain the required tool members 20.

Figure 4:
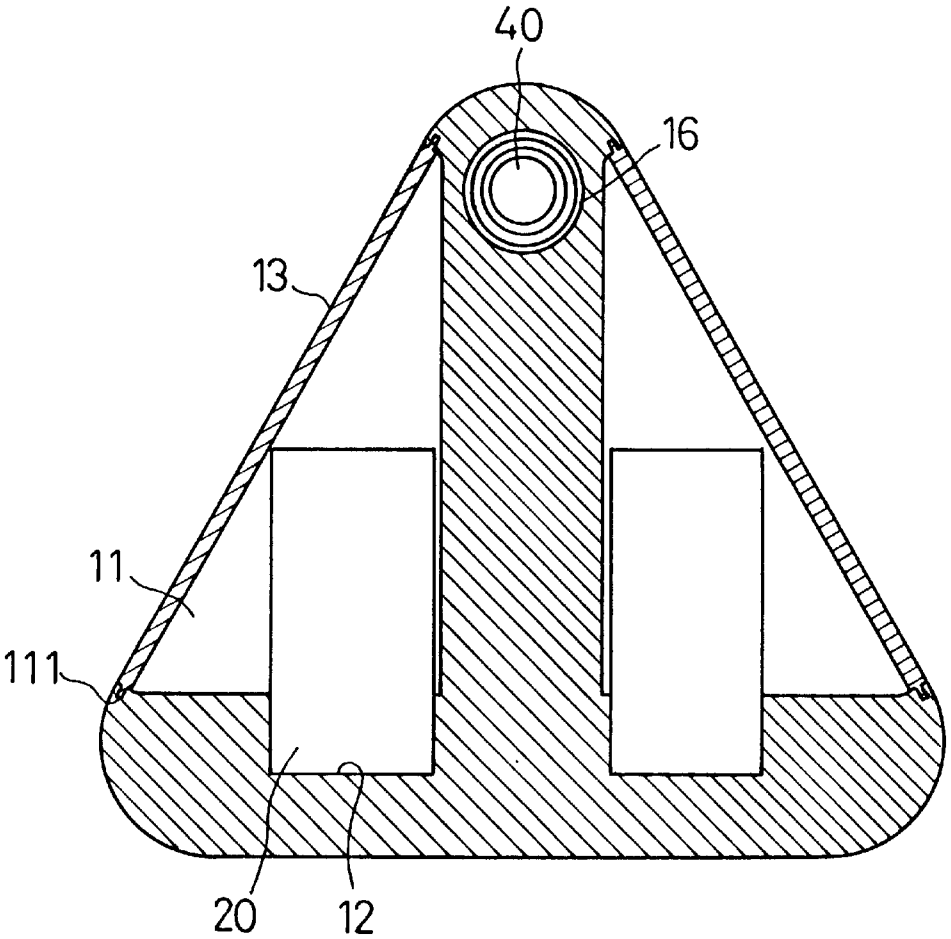
FIGS. 4 and 5 are cross sectional views taken along lines 4—4 and 5—5 of FIG. 2 respectively.
Figure 5:
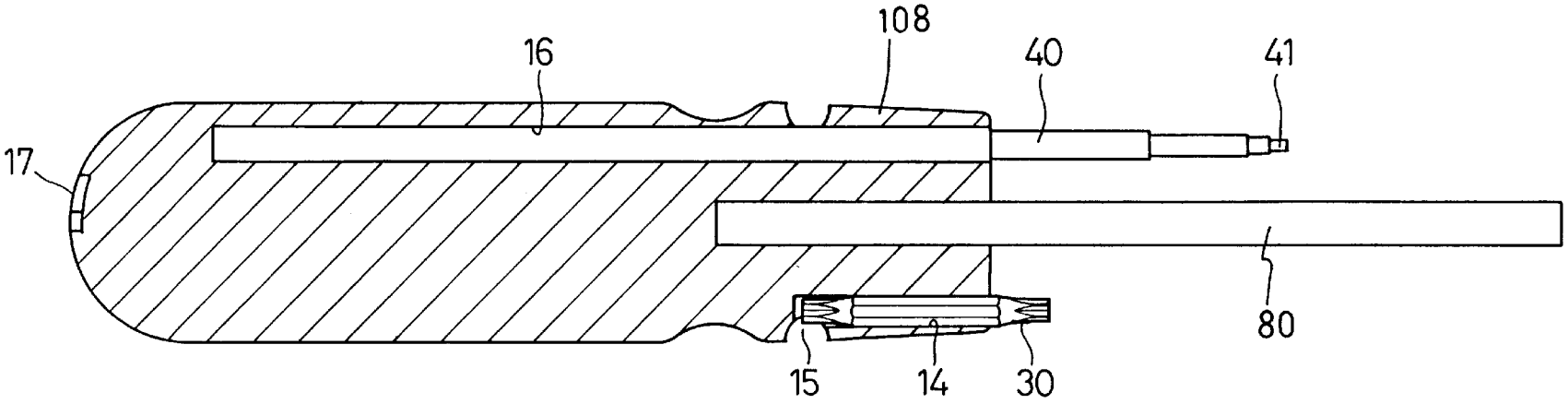

The handle 10 includes one or more orifices 14 formed in one end or the front end 108 of the handle 10 for receiving tool members, such as the tool bits 30, and includes a peripheral groove 15 and communicating with the orifices 14 (FIGS. 1, 2, 5) for allowing the user to easily view and obtain the tool members 30 of the required type or size. The handle 10 includes an aperture 16 formed therein and communicating with the peripheral groove 15 of the handle 10. A telescopic tube 40 is received in the aperture 16 (FIGS. 4, 5) and includes a magnet 41 attached to the free end portion thereof and extendible outward of the handle 10 for attracting the fasteners, for example.

It is to be noted that the telescopic tube 40 is not engaged in the driving stem 80 and is separated from the driving stem 80 such that the telescopic tube 40 will not affect the operation of the driving stem 80. The typical tools include a telescopic tube engaged in the driving stem such that the telescopic tube should be completely received in the driving stem before the driving stem may be used.

Referring again to FIG. 3, the rear end of the handle 10 includes a T-shaped depression 17 formed therein for engaging with and for receiving the other types of the fasteners 50 and for allowing the fasteners 50 to be driven by the handle 10.

Accordingly, the tool in accordance with the present invention includes a handle having a structure for receiving a lot of tool members.

Although this invention has been described with a certain degree of particularity, it is to be understood that the present disclosure has been made by the way of example only and that numerous changes in the detailed construction and the combination and arrangement of parts may be resorted to without departing from the spirit and scope of the invention as hereinafter claimed.

I claim:

1. A tool comprising:

a handle including a first end having at least one orifice formed therein for receiving a tool member and having a peripheral groove formed therein and communicating with said at least one orifice for allowing a user to view the tool member, said handle including a second end and including a middle portion having at least one chamber formed therein and having at least one cavity formed therein and communicating with said at least one chamber for receiving another tool member, and a driving stem secured to said first end of said handle for driving the tool members.

2. The tool according to claim 1, wherein said handle further includes an aperture formed in said first end of said handle, and a telescopic tube engaged in said aperture of said handle and having a magnet extendible outward of said handle for attracting the tool members.

3. The tool according to claim 2, wherein said aperture is communicated with said peripheral groove of said handle.

4. The tool according to claim 1 further comprising at least one door detachably attached to said handle for enclosing said at least one chamber of said handle.

5. The tool according to claim 4, wherein said handle includes at least one pair of channels formed therein for slidably receiving said at least one door and for allowing said at least one door to be detachably attached to said handle.

6. The tool according to claim 1, wherein said second end of said handle includes a T-shaped depression formed therein for engaging with and for driving a further tool member.

7. The tool according to claim 1, wherein said handle includes a triangle cross section.

8. A tool comprising:

a handle including a triangular cross section and including a first end having at least one orifice formed therein for receiving a tool member and having a peripheral groove formed therein and communicating with said at least one orifice for allowing a user to view the tool member, said handle including a second end and including a middle portion having at least one chamber formed therein and having at least one cavity formed therein and communicating with said at least one chamber for receiving another tool member, said handle including at least one pair of channels formed therein and including an aperture formed in said first end thereof and communicated with said peripheral groove of said handle, said second end of said handle including a T-shaped depression formed therein for engaging with and for driving a further tool member, a telescopic tube engaged in said aperture of said handle and having a magnet extendible outward of said handle for attracting the tool members, a driving stem secured to said first end of said handle for driving the tool members, and at least one door slidably engaged with said at least one pair of channels of said handle and detachably attached to said handle for enclosing said at least one chamber of said handle.

* * * * *